US005200244A

United States Patent [19]

Keller

[11] Patent Number: 5,200,244

[45] Date of Patent: Apr. 6, 1993

[54] SHOWER WALL PATCH

[76] Inventor: Michael A. Keller, P.O. Box 423 216 E. Dawes, Cannon Beach, Oreg. 97110

[21] Appl. No.: 719,613

[22] Filed: Jun. 24, 1991

[51] Int. Cl.[5] ..... B32B 3/08

[52] U.S. Cl. ..... 428/81; 428/119; 428/131; 428/63; 52/514

[58] Field of Search ..... 52/514, 169.7; 428/77, 428/78, 81, 119, 131, 137, 40, 63

[56] References Cited

U.S. PATENT DOCUMENTS 4,297,823 11/1981 Keisler ..... 52/514

*Primary Examiner*—Alexander S. Thomas

*Attorney, Agent, or Firm*—Leon Gilden

[57] ABSTRACT

A member adherably mounted to a shower wall to overlie broken and discolored portions contiguous when adjacent shower stall and bathtub valves and nozzles is provided, including a central planar mounting plate formed with a perimeter flange of a "U" shaped configuration, with a mounting flange positioned about the perimeter flange to accommodate caulking and water sealing compounds thereon. The patch member accordingly provides for a securable mounting arrangement that in a modified form utilizes various peel-away layers to provide various patterns to accommodate adjacent tile structure.

2 Claims, 4 Drawing Sheets

SHOWER WALL PATCH

BACKGROUND OF THE INVENTION

1. Field of the Invention

The field of invention relates to wall patch methods and apparatus, and more particularly pertains to a new and improved shower wall patch wherein the same is arranged for convenience and mounting in a laminated configuration about a wall of a shower stall and in contiguous communication with a bathtub member and the like at a lower terminal end thereof.

2. Description of the Prior Art

During constant use of various shower stall equipment, the handles and associated fluid conduit associated with an underlying bathtub are frequently in need of repair, whereas the instant invention sets forth an organization to provide a unitary covering member that provides not only masking of such disfigured tile and the like, but provides for a unitary member to secure and maintain the wall preventing and minimizing further degradation thereof. Prior art wall patch structure is exemplified in U.S. Pat. No. 4,510,728 to Key wherein a wall patch adapter utilizes a plurality of plates joined together in a super-imposed manner by means of a rotatably eccentric to permit the plates to be adjusted relative to one another to fitted within a hole and a damaged wall.

U.S. Pat. No. 4,311,656 to Spriggs sets forth a method for repairing damage to plaster board wall utilizing a plate member mounted within the damaged wall area.

U.S. Pat. No. 4,825,605 to Weir sets forth a closure for wall openings such as utilized in swimming pool arrangements.

U.S. Pat. No. 4,620,407 to Schmid sets forth a method for repairing dry wall in gypsum type board utilizing a template to initially sever or cut out a portion of the dry wall to be damaged providing a plug to be positioned within the damaged area.

U.S. Pat. No. 4,358,495 to Parker sets forth a dry wall patch unit utilizing a facing member submitted to backing material for securement to the dry wall in patching thereof.

As such, it may be appreciated that there continues to be a need for a new and improved shower wall patch as set forth by the instant invention which addresses both the problems of ease of use as well as effectiveness in construction providing a unitary member arranged for securement to various tile structure and accommodating various plumbing fixtures directed through the patch organization and in this respect, the present invention substantially fulfills this need.

SUMMARY OF THE INVENTION

In view of the foregoing disadvantages inherent in the known types of wall patch structure now present in the prior art, the present invention provides a shower wall patch wherein the same provides for a flexible polymeric material arranged for adhering and securement to a tile surface to maintain geometric integrity of the tile, as well as providing a masking thereof in use. As such, the general purpose of the present invention, which will be described subsequently in greater detail, is to provide a new and improved shower wall patch which has all the advantages of the prior art wall patch structure and none of the disadvantages.

To attain this, the present invention provides a member adherably mounted to a shower wall to overlie broken and discolored portions contiguous when adjacent shower stall and bathtub valves and nozzles, including a central planar mounting plate formed with a perimeter flange of a "U" shaped configuration, with a mounting flange positioned about the perimeter flange to accommodate caulking and water sealing compounds thereon. The patch member accordingly provides for a securable mounting arrangement that in a modified form utilizes various peel-away layers to provide various patterns to accommodate adjacent tile structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shower wall patch which has all the advantages of the prior art wall patch structure and none of the disadvantages.

It is another object of the present invention to provide a new and improved shower wall patch which may be easily and efficiently manufactured and marketed.

It is a further object of the present invention to provide a new and improved shower wall patch which is of a durable and reliable construction.

An even further object of the present invention is to provide a new and improved shower wall patch which is susceptible of a low cost of manufacture with regard to both materials and labor, and which accordingly is then susceptible of low prices of sale to the consuming public, thereby making such shower wall patches economically available to the buying public.

Still yet another object of the present invention is to provide a new and improved shower wall patch which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
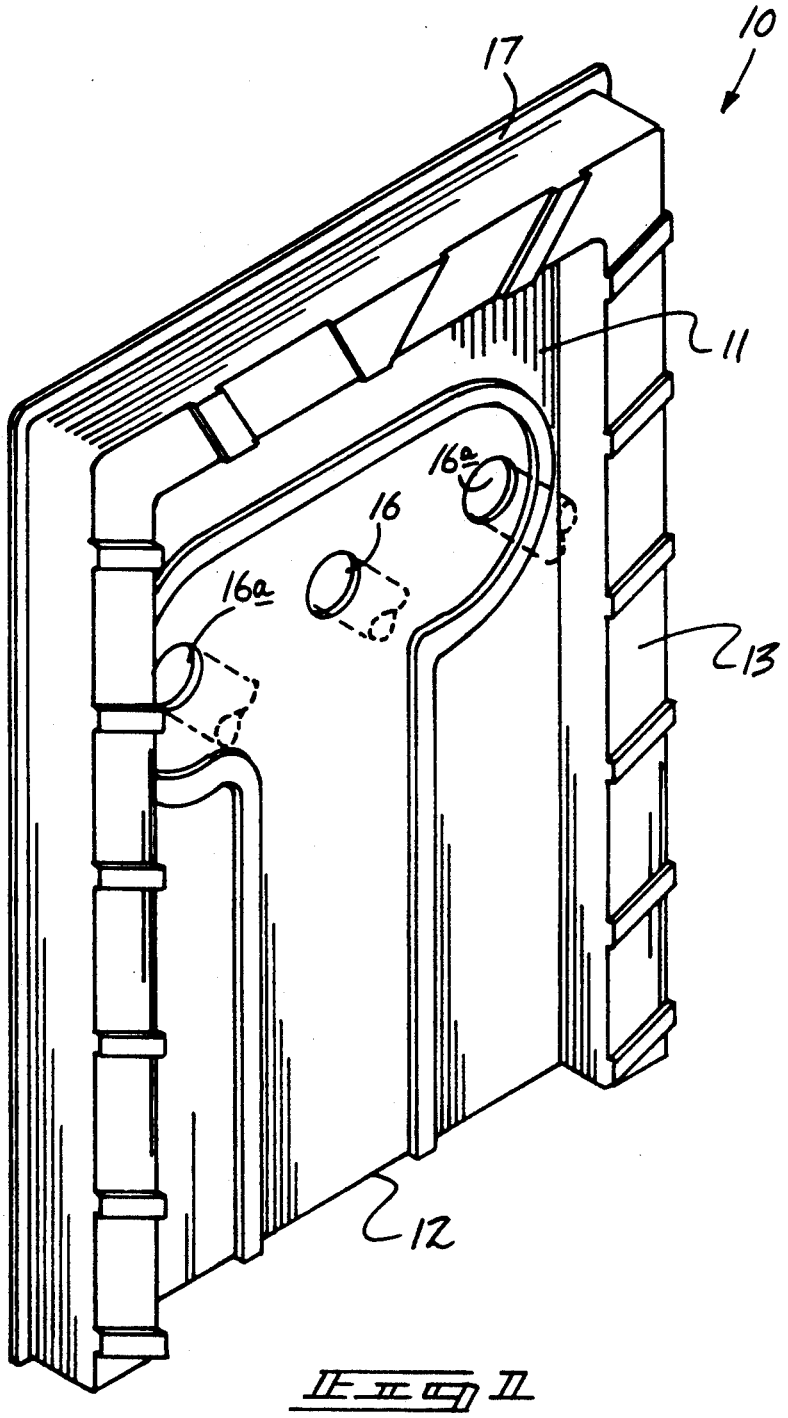
FIG. 1 is an isometric illustration of the instant invention.

With reference now to the drawings, and in particular to FIGS. 1 to 5 thereof, a new and improved shower wall patch embodying the principles and concepts of the present invention and generally designated by the reference numeral 10 will be described.

Figure 2:
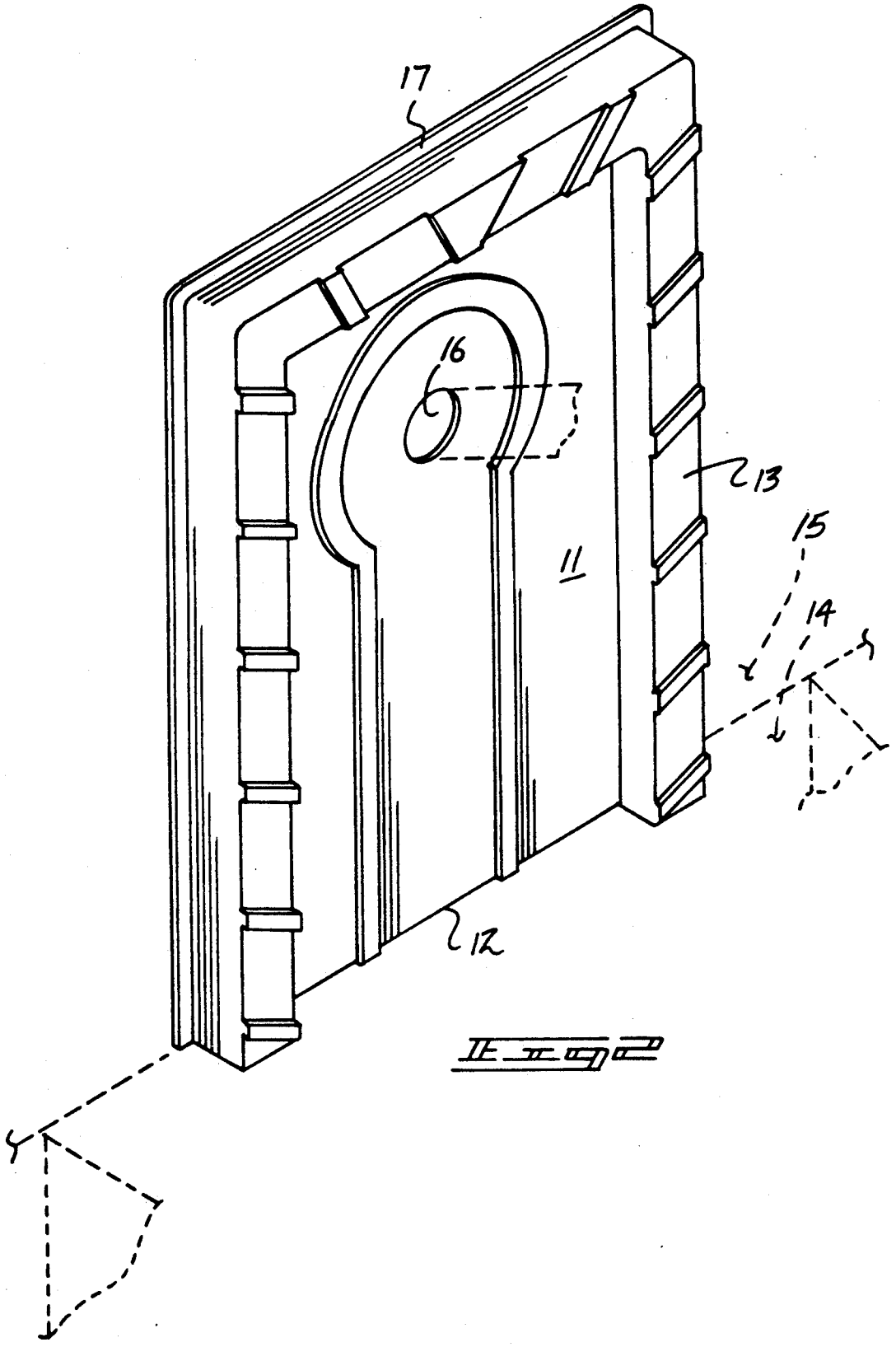
FIG. 2 is an isometric illustration of the instant invention illustrating a single opening directed therethrough for accommodating a single fluid conduit.

More specifically, the shower wall patch 10 of the instant invention sets forth a unitary member formed of a polymeric fluid impermeable material, including a central flange plate 11 defined by a bottom edge 12, with a "U" shaped perimeter flange 13 mounted orthogonally and extending outwardly of the flange plate 11, with the perimeter flange 13 including a planar lip flange 17 mounted contiguous to and orthogonally relative to the perimeter flange 13 extending laterally and exteriorly thereof in a coplanar relationship of the planar lip flange with the central flange plate 11. The planar lip flange 17 accommodates caulking, adhesives, and the like for preventing fluid from entering a rear surface of the central flange plate 11. The central flange plate 11 typically includes the bottom edge 12 in contiguous abutment to a bathtub member 14, with the flange plate 11 mounted to a shower wall 15, as illustrated in FIG. 2 for example. A central opening 16 accommodates a fluid conduit or faucet directed therethrough relative to the bathtub structure, wherein control valve lever openings 16*a*, such as illustrated in FIG. 1, accommodate control valves directed therethrough, wherein alternatively, as illustrated in FIG. 2, only a single opening 16 may be utilized, wherein a remotely positioned control valve arrangement is provided.

Figure 3:
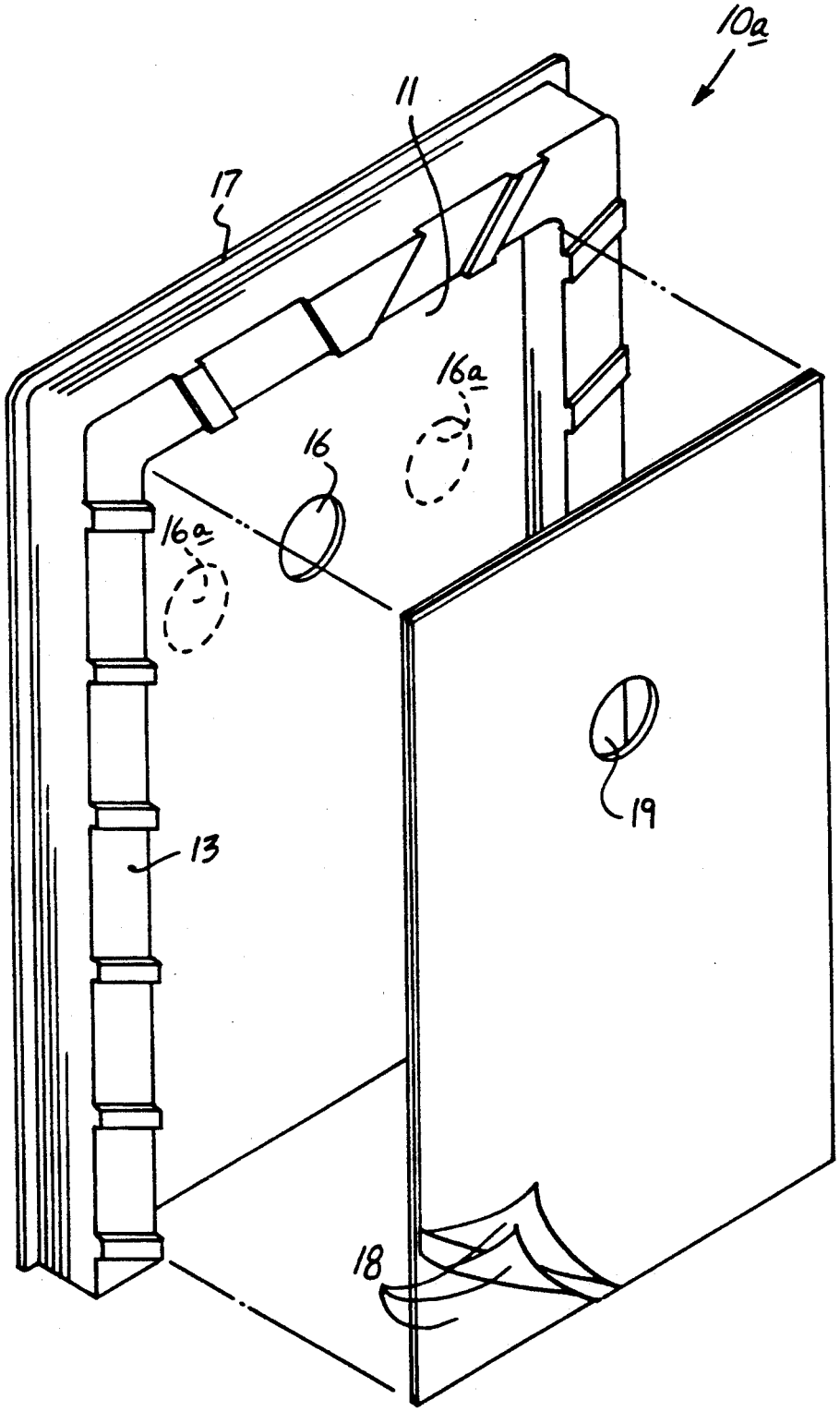
FIG. 3 is an isometric illustration defining a modification of the invention.

The invention, as illustrated in FIG. 3, is depicted as the shower wall patch 10*a* and includes a plurality of peel-away super-imposed layer webs 18 adhesively mounted relative to and coextensively relative to one another including a central web opening 19 that is coaxially aligned throughout the webs 18. The webs 18 are formed of various colorations and patterns to accommodate surrounding tile, as is required, to match for enhanced comfort of an individual utilizing the patch structure 10*a*.

Figure 4:
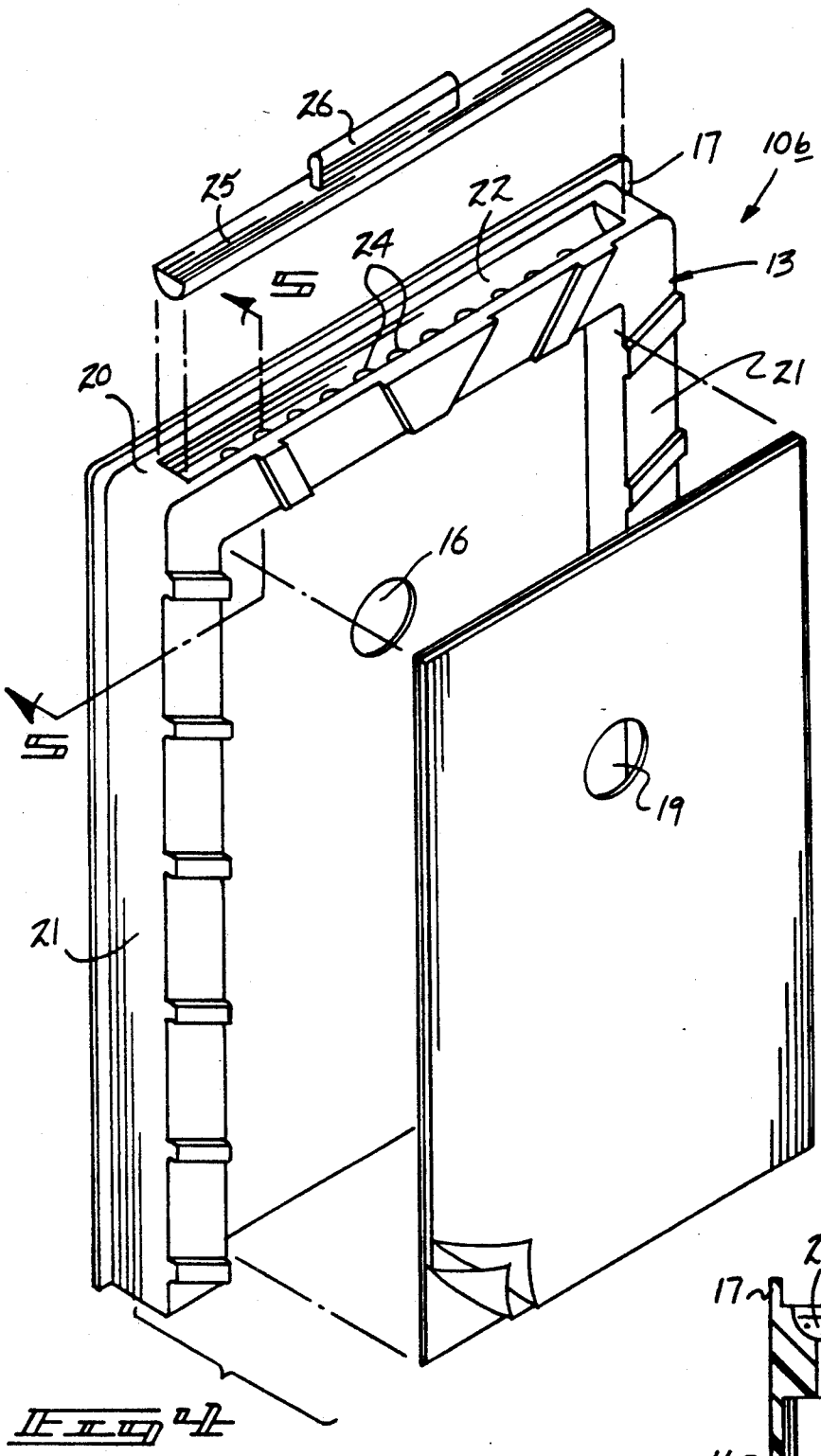
FIG. 4 is an isometric illustration setting forth a further modification of the invention.
Figure 5:
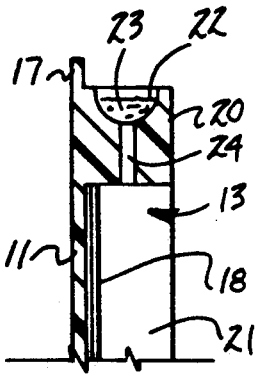
FIG. 5 is an orthographic view, taken along the lines 5—5 of FIG. 4 in the direction indicated by the arrows.

The further modified structure 10*b*, as illustrated in FIGS. 4 and 5, defines the perimeter flange 13 with a top leg 20 and parallel side legs extending downwardly relative to the top leg 20, wherein the top side legs 21 are parallel relative to one another, wherein the top leg 20 includes a top flange trough 22 directed through a top surface of the top leg 20. The trough 22 includes a plurality of trough feed conduits 24 directed from a lower portion of the trough 22 to direct a cleaning fluid 23, such as detergent and the like positioned within the trough to feed through the conduits 24 onto the central flange plate 11 and the webs 18 to effect cleaning thereof minimizing need for manual cleaning of the surface minimizing mildew and dirt buildup upon the webs 18 or the central flange plate 11. A trough cover lid 25 is provided complementarily configured relative to the configuration of the trough 22, wherein the lid 25 includes a handle 26 to permit ease of manual positioning of the lid 25 within the trough during periods of non-use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shower wall patch arranged for securement to a vertical wall, with a bathtub member mounted against a lower portion of the vertical wall, wherein the shower wall patch comprises, a central flange plate, the central flange plate including a bottom edge, and a "U" shaped perimeter flange fixedly and orthogonally mounted to a perimeter of the flange plate, with the perimeter flange defining an opening, with the bottom edge positioned in alignment with the opening, and a planar lip flange coplanar with the flange plate positioned exteriorly of and coextensive with the "U" shaped perimeter flange to accommodate caulking and sealing thereof, the central flange, the perimeter flange, and the lip flange formed of a polymeric material.

2. A patch as set forth in claim 1 wherein at least one opening is directed through the central flange plate to receive a fluid conduit therethrough.

* * * * *